United States Patent [19]

Suzuki et al.

[11] 4,105,501

[45] Aug. 8, 1978

[54] METHOD FOR PRODUCING METALLURGICAL COKE

[75] Inventors: Gyoichi Suzuki, Tokyo; Mitsutoshi Miura, Yokohama; Takashi Miyazu; Taro Matsushita, both of Tokyo; Yasuo Okuyama, Yokohama, all of Japan

[73] Assignee: Nippon Kokan Kabushiki Kaisha, Tokyo, Japan

[21] Appl. No.: 730,975

[22] Filed: Oct. 8, 1976

[30] Foreign Application Priority Data

Oct. 23, 1975 [JP] Japan ..... 50/126869

[51] Int. Cl.[2] ..... C10B 53/04; C10B 53/00; C10B 47/10

[52] U.S. Cl. ..... 201/6; 201/8; 201/13; 201/21; 201/23; 201/24; 201/42

[58] Field of Search ..... 201/6, 8, 9, 13, 21, 201/23, 24, 42; 44/10 R, 14

[56] References Cited

U.S. PATENT DOCUMENTS

| | | | |
|---|---|---|---|
| 2,907,698 | 10/1969 | Schulz | 201/8 |
| 3,010,882 | 11/1961 | Barclay et al. | 201/6 UX |
| 3,151,041 | 9/1964 | Heinz | 201/6 |
| 3,377,146 | 4/1968 | von Stroh | 44/10 R |
| 3,444,047 | 5/1969 | Wilde | 201/6 |
| 3,663,186 | 5/1972 | Dzhaparidge | 201/6 X |
| 3,725,038 | 4/1973 | Wenzel et al. | 201/5 |
| 3,838,988 | 10/1974 | Sanada et al. | 201/6 X |
| 3,883,399 | 5/1975 | Nire | 201/6 |
| 3,907,648 | 9/1975 | Nire et al. | 201/6 |
| 4,185,635 | 5/1965 | Creglow | 201/6 X |

FOREIGN PATENT DOCUMENTS 1,155,851 5/1958 France.

OTHER PUBLICATIONS

ASTM 2639-74, Plastic Properties of Coal by the Constant-Torque Gieseler Plastometer.

*Primary Examiner*—Morris O. Wolk
*Assistant Examiner*—Michael S. Marcus
*Attorney, Agent, or Firm*—Flynn & Frishauf

[57] ABSTRACT

With the use of low-fluidity blended raw material coal fines having a maximum fluidity of up to 20 d.d.p.m. as an inner core material, and coal fines having a maximum fluidity of at least 30 d.d.p.m. or a bituminous material having a C/H ratio of from 0.7 to 1.9 as an outer envelope material, green composite briquettes are formed by covering said inner core material with said outer envelope material. Said green composite briquettes thus formed are charged into a conventional coke oven battery and carbonized by an ordinary process, whereby a high-strength metallurgical formed coke in a slight mutual agglomeration is produced.

8 Claims, No Drawings

METHOD FOR PRODUCING METALLURGICAL COKE

FIELD OF THE INVENTION

Method for producing a high-strength metallurgical formed coke in a slight mutual agglomeration principally from low-fluidity blended raw material coal fines having a maximum fluidity of up to 20 d.d.p.m. using a conventional coke oven battery.

BACKGROUND OF THE INVENTION

It is impossible to commercially produce a high-strength metallurgical coke by charging low-fluidity blended raw material coal fines having a maximum fluidty of up to 20 d.d.p.m. in the form of fine particles as they are into a conventional coke oven battery. Production of only a low-strength coke is inevitable in this manner. There is therefore proposed a method for producing a formed coke, as a solution to the above-mentioned inconvenience, which comprises charging and carbonizing green briquettes obtained by compression-forming the blended raw material coal fines of a low fluidity mentioned above in a conventional coke oven battery.

According to this method, the strength of individual pieces of formed coke is certainly improved. However, the low fluidity of the blended raw material coal fines prevents mutual agglomeration between pieces of formed coke, and in consequences, it is impossible, in a conventional coke oven battery, to discharge therefrom a formed coke with the use of a coke pusher.

A conventional coke oven battery for producing metallurgical coke comprises coking ovens for carbonizing a coal charge, combustion chambers for causing combustion of a fuel gas, regenerators for storing the remaining heat of a combustion waste gas and sole flues for guiding the combustion waste gas into a stack. The coking ovens and the combustion chambers are alternately arranged on the regenerators and thus form a coke oven battery. Each combustion chamber comprises many flues where a fuel gas is burnt. Coke is produced by heating and carbonizing a coal charge in the coke ovens on both sides of the combustion chamber through oven walls by said combustion. The produced coke is pushed horizontally over a distance of about 16 meters by a coke pusher installed on one side of the coking ovens, and thus discharged therefrom from the other side of the coking ovens. Pieces of the formed coke produced from green briquettes obtained by compression-forming the blended raw material coal fines of a low fluidity as mentioned above are not in mutual agglomeration, and there is no gap between the oven wall and the formed coke. The force applied by the coke pusher therefore also acts laterally, i.e., in the direction of the oven wall, thus causing a considerably high frictional resistance between the formed coke and the oven wall. The resulting abnormally raised load current of the coke pusher not only makes it very difficult or even impossible to discharge the formed coke to the outside of the oven, but also may cause a serious trouble such as breakage of the oven wall.

In order to produce a formed coke from blended raw material coal fines of a low fluidity as mentioned above, therefore, it is necessary to use a coke oven battery provided with a special oven sole permitting discharge of produced formed coke by a coke pusher, or a shaft furnace permitting discharge of produced formed coke by gravity. However, it is impossible, in such an oven and furnace, to produce a formed coke efficiently in a large quantity.

SUMMARY OF THE INVENTION

An object of the present invention is therefore to provide a method for efficiently producing a high-strength metallurgical formed coke in a slight mutual agglomeration principally from low-fluidity blended raw material coal fines having a maximum fluidity of up to 20 d.d.p.m. using a conventional coke oven battery.

In accordance with one of the features of the present invention, there is provided a method for producing a high-strength metallurgical formed coke in a slight mutual agglomeration, which comprises: forming green composite briquettes by covering an inner core material with an outer envelope material, said inner core material comprising blended raw material coal fines having a maximum fluidity of up to 20 d.d.p.m., and said outer envelope material comprising coal fines having a maximum fluidity of at least 30 d.d.p.m. or a bituminous material having a C/H ratio of from 0.7 to 1.9; charging said green composite briquettes thus formed into a conventional coke oven battery; and carbonizing same by ordinary process.

DETAILED DESCRIPTION OF PREFERRED EMBODIMENTS

In the present invention, green composite briquettes are formed by covering an inner core material with an outer envelope material, said inner core material comprising blended raw material coal fines having a maximum fluidity of up to 20 d.d.p.m., and said outer envelope material comprising coal fines having a maximum fluidity of at least 30 d.d.p.m. or a bituminous material having a C/H ratio of from 0.7 to 1.9; charging said green composite briquettes thus formed into a conventional coke oven battery; and carbonizing same by an ordinary process, thereby producing a high-strength formed coke in a slight mutual agglomeration.

The term d.d.p.m. as herein used, an abbreviation of the dial divisions per minute, is an indication of the fluidity of a coal well known to persons skilled in the art, and is specified in detail in ASTM D2639-74.

The reason why the maximum fluidity of blended raw material coal fines used as an inner core material is limited to 20 d.d.p.m. at the maximum is as follows. When a formed coke is produced with the use of blended raw material coal fines having a maximum fluidity of over 20 d.d.p.m., mutual agglomeration is readily achieved between pieces of formed coke. It is not therefore necessary in this case to form green composite briquettes comprising an inner core material and an outer envelope material as in the present invention. In fact, for example, when employing blended raw material coal fines substantially comprising American low-volatile bituminous coals, pieces of formed coke are mutually agglomerated, even with a maximum fluidity of about 30 d.d.p.m.

A metallurgical coke, especially a coke for a blast furnace is required to have a strength of at least 92.0 in terms of $DI_{15}^{30}$. In order to obtain a desired coke strength, therefore, the particle size of blended raw material coal fines used as an inner core material should be kept at 1.5 mm at the maximum, and preferably, at 1.0 mm at the maximum.

The low-fluidity blended raw material coal fines having the aforementioned maximum fluidity and particle size and serving as an inner core material are kneaded by adding a known binder such as asphalt, coal tar and pitch, in an appropriate amount and are compression-formed into briquettes by a forming machine, or are formed into pellets.

In the present invention, the above-mentioned inner core material is covered with the outer envelope material with a view to ensuring slight mutual agglomeration between pieces of formed coke in carbonizing in the coke oven battery. Therefore, the maximum fluidity of the coal fines used as an outer envelope material should be at least 30 d.d.p.m.

Pieces of the formed coke produced in accordance with the present invention, being in a slight mutual agglomeration due to the high co-agglomeration property of said outer envelope material at the time of coke discharge, are separated into individual pieces of formed coke under the impact caused by dropping onto a coke wharf, starting from the agglomerated surfaces between said outer envelopes. In this separation, low strength of said outer envelope material results in breakage of the outer envelopes into undesirable small pieces, thus producing substantial crushed fines and leading to less economical cokemaking. In order to prevent the occurrence of such crushed fines, therefore, it is desirable to use coal fines having an A. P. index of at least 70% as an outer envelope material.

The A. P. index, an abbreviation of the Agglomeration Property Index, herein employed, is defined as the percentage obtained by: crushing a coal sample in an amount of 35 g to a size of 1 mm at the maximum; kneading by adding, as a binder, a 10 wt.% special asphalt (C/H: 0.71; softening point: 69° C; Conradson carbon: 25.2%); forming green briquettes with the use of a compression-forming machine under a pressure of 300 kg/cm$^2$; charging said green briquettes into an experimental coke oven at an oven temperature of 500° C and carbonizing same to a final temperature of 900° C to produce a formed coke; putting the formed coke thus obtained into a drum testing machine for Roga index (200 mm dia. × 70 mm long; 50 r.p.m.; ISO R335); after turning said drum 1,000 times, sieving said formed coke through a 3 mm screen; and calculating the ratio of the oversize coke weight to the formed coke weight before sieving.

In the present invention, a bituminous material having a C/H ratio of from 0.7 to 1.9 may be employed as an outer envelope material in place of the coal fines having the aforementioned maximum fluidity and A. P. index. Recommendable bituminous materials for this purpose include: coal tar; coal tar pitch, emulsified coal tar pitch; asphalt; modified asphalt such as asphalt debituminized by propane and asphalt heat-treated under a hydrogen atmosphere, and emulsified asphalt.

The C/H ratio of said bituminous material used as an outer envelope material is limited to the range of from 0.7 to 1.9 in view of results of experiments carried out to ascertain the most effective range ensuring slight mutual agglomeration between pieces of formed coke in carbonizing in a coke oven battery. More specifically, with a C/H ratio of under 0.7, the bituminous material itself is mostly evaporated and dispersed, thus making it impossible to achieve mutual agglomeration of formed coke, whereas with a C/H ratio of over 1.9, the viscosity of the bituminous material decreases and this also prevents satisfactory mutual agglomeration between pieces of formed coke.

The thickness of the outer envelope material covering the inner core material is preferably within the range of from 0.5 mm to 10 mm depending upon the size of the inner core. More specifically, with an outer envelope thickness of under 0.5 mm, there is only an insufficient agglomerating power of formed coke, whereas with an outer layer thickness of over 10 mm, of a substantial quantity crushed fines may be produced when the formed coke in a slight mutual agglomeration drops onto a cake wharf.

Green composite briquettes comprising said inner core material and said outer envelope material covering the inner core material may be produced by: first forming only an inner core material as mentioned above, and sprinkling and covering the surface of the inner core material thus formed with said coal fines serving as an outer envelope material; or, dipping the inner core material into said bituminous material rendered liquid by heating or emulsification, or spraying said liquefied bituminous material onto the surface of said inner core material, to cause deposition of the bituminous material onto the surface of the inner core material. Alternatively, furthermore, green composite briquettes may be directly formed with the use of a forming machine capable of pressing into a cylindrical form with double layers or a double-roll forming machine, by feeding the inner core material and the outer envelope material.

The green composite briquettes obtained as mentioned above are charged into a conventional coke oven battery to carbonize same by an ordinary process.

Now, the present invention is described more in detail by way of examples.

EXAMPLE 1

Blended raw material coal fines of a particle size of 1.5 mm at the maximum to serve as an inner core material were prepared by blending raw material coal fines as follows:

Australian Black Water Coal: 20 wt.%,
Canadian weathered Balmer Coal: 30 wt.%,
Russian Kuznetsk OS Coal: 30 wt.%, and
Delayed oil coke made in U.S.A.: 20 wt.% Said blended raw material coal fines had the following properties:
A.P. index: 83.1%,
Maximum fluidity: 2.5 d.d.p.m.,
Ash content: 7.4 wt.%,
Volatile matter content: 18.5 wt.%, and
Mean maximum reflectance: 1.77%

The mean maximum reflectance is obtained by: crushing a coal sample to a size of 20 mesh at the maximum; freezing the crushed coal sample with an acrylic resin and polishing same; and measuring the reflectance of light of the vitrinite in an oil in compliance with ASTM D2797-72 and D2798-72.

Said blended raw material coal fines were kneaded by adding 10 wt.% modified asphalt debituminized by propane, and then formed with a compression-forming machine to produce green briquettes serving as inner cores.

The green briquettes serving as inner cores thus obtained were then covered respectively with the following three kinds of outer envelope material to produce three kinds of green composite briquettes:

(a) Australian weak-coking coal fines with a maximum fluidity of 100 d.d.p.m. and an A.P. index of 86%;

(b) American medium-volatile coal fines with a maximum fluidity of 2,700 d.d.p.m. and an A.P. index of 93%; and (c) Modified asphalt debituminized by propane to have a C/H ratio of 0.71.

From among these outer envelope materials, those of (a) and (b) were deposited on the surface of the green briquettes serving as inner cores by sprinkling the latter with coal fines, whereas in the case of (c), the modified asphalt liquefied by heating was sprayed onto the surface of green briquettes serving as inner cores. Green composite briquettes each comprising an inner core and an outer envelope were thus obtained.

The green composite briquettes thus obtained were charged into a conventional coke oven battery and carbonized by an ordinary process. Properties of the produced formed coke are indicated in Table 1.

Table 1

| Kinds of outer envelope material | Size of green briquette (mm) | Weight of deposited outer envelope material (wt. %) | Load current on coke pusher (standard: 130A) | Percentage of co-agglomeration of formed coke (wt. %) | Strength of formed coke ($DI_{15}^{30}$) |
|---|---|---|---|---|---|
| (a) | 32×43×43 | 17.1 | 135 | 80 | 93.0 |
| (b) | " | 15.0 | 130 | 93 | 92.0 |
| (c) | " | 9.0 | 120 | 91 | 92.5 |
| None | " | 0 | 200< | 34 | 94.0 |

In Table 1, the formed cokes respectively covered with the above-mentioned outer envelope materials (a), (b) and (c) are those within the scope of the present invention, and the formed coke without an outer envelope material shown on the bottom line is the one outside the scope of the present invention.

In Table 1 also, the coke strength $DI_{15}^{30}$ indicates values measured in accordance with JIS K-2151. In Table 1, furthermore, the percentage of co-agglomeration of formed coke indicates the ratio of the weight of mutually agglomerated pieces of formed coke to the total weight of the formed coke, expressed in percentage.

As is clear from Table 1, the formed cokes within the scope of the present invention showed a high percentage of co-agglomeration as 80 to 93%, and the load current on the coke pusher of 120 to 135 A was therefore close to the standard load current of 130 A, this indicating easy discharge of formed coke by the coke pusher. On the contrary, the formed coke outside the scope of the present invention, without an outer envelope material, showed a low percentage of co-agglomeration as 34%; the load current on the coke pusher therefore exceeded 200 A, being abnormally high as compared with the standard load current of 130 A. It was therefore impossible to discharge the formed coke by the coke pusher and the coke was discharged by human labor.

EXAMPLE 2

For the purpose of investigating the relationship between the maximum fluidity of coal fines used as an outer envelope material and the percentage of co-agglomeration of the produced formed coke, five kinds of coal fines having a maximum fluidity of from 10 to under 20 d.d.p.m., from 20 to under 30 d.d.p.m., from 30 to under 50 d.d.p.m., from 50 to under 150 d.d.p.m., and 150 d.d.p.m. and over were used as outer envelope materials, and green composite briquettes each comprising an inner core material and an outer envelope material were obtained in the same manner as in Example 1. The green composite briquettes thus obtained were charged into a conventional coke oven battery and carbonized by an ordinary process to produce a formed coke. The percentage of co-agglomeration, the strength, the condition of discharge and the load current on the coke pusher were measured on the formed coke thus obtained. The results of measurement are shown in Table 2.

Table 2

| Maximum fluidity of inner core material (d.d.p.m.) | Outer envelope material: Maximum fluidity (d.d.p.m.) | Outer envelope material: A.P. index (%) | Percentage of co-agglomeration of formed coke (wt. %) | Load current on coke pusher (standard: 130A) | Discharge of formed coke by coke pusher | Strength of formed coke ($DI_{15}^{30}$) |
|---|---|---|---|---|---|---|
| | 150 min. | | 90 – 100 | | | |
| | | | | 140 – 160 | | |
| 0 – 20 | 50 – under 150 | 70 min. | 70 – 90 | | Possible | 92 – 95 |
| | 30 – under 50 | | 60 – 70 | 160 – 190 | | |
| | 20 – under 30 | | 30 – 60 | | | |
| 0 – 20 | | 70> | | 230 < | Impossible | 92 – 95 |
| | 10 – under 20 | | 10 – 30 | | | |

As shown in Table 2, a higher maximum fluidity of coal fines used as an outer envelope material results in a higher percentage of co-agglomeration of formed coke, and hence in a lower load current on the coke pusher. In the cases where the maximum fluidity of the coal fines used as an outer envelope material was within the scope of the present invention, i.e., in the cases where the maximum fluidity was at least 30 d.d.p.m., the formed coke had a high percentage of co-agglomeration of 60 to 100%, thus permitting discharge of the formed coke by the coke pusher. In contrast, in the cases where the maximum fluidity of the coal fines used as an outer envelope material was outside the scope of the present invention, i.e., in the cases where the maximum fluidity was under 30 d.d.p.m., the percentage of co-agglomeration of the formed coke was as low as 10 to 60%, thus making it extremely difficult or even impossible to discharge the formed coke by the coke pusher.

As described above in detail, since pieces of the formed coke produced in accordance with the present invention are in a slight mutual agglomeration by the presence of an outer envelope material at the time of discharge from a coke oven battery, it is possible to discharge same by a conventional coke pusher of a coke oven battery. Furthermore, by the impact upon dropping onto a coke warf, a mass of pieces of formed coke in a slight mutual agglomeration is broken starting from the agglomerated surfaces between said outer envelopes and separated into individual pieces again. This not only eliminates the necessity of sieving, but also minimizes the risk of producing crushed fines. Moreover, the formed coke of the present invention has a coke strength $DI_{15}^{30}$ of at least 92.0, a sufficient strength required as a metallurgical coke. According to the present invention, therefore, it is possible to produce a high-strength metallurgical formed coke in a high yield, in a conventional coke oven battery, principally from low-fluidity blended raw material coal fines having a maximum fluidity of up to 20 d.d.p.m., thus providing industrially useful effects.

What is claimed is:

1. A method for producing a high-strength metallurgical formed coke in a slight mutual agglomeration, which comprises:

forming green briquettes serving as an inner core material, said green briquettes comprising blended raw material coal fines having a maximum fluidity of up to 20 d.d.p.m.;

covering said green briquettes with an outer envelope material to a thickness of from 0.5 to 10 mm, said outer envelope material consisting essentially of coal fines having a maximum fluidity of at least 30 d.d.p.m. and an A.P. index of at least 70%;

charging the resulting green composite briquettes into a horizontal coke oven battery; and carbonizing said green composite briquettes in said battery.

2. The method as claimed in claim 1, wherein said blended raw material coal fines serving as an inner core material have a particle size of up to 1.5 mm.

3. The method as claimed in claim 1, wherein said blended raw material coal fines serving as an inner core material have a particle size of up to 1.0 mm.

4. The method as claimed in claim 1, wherein the coke formed in said battery is discharged horizontally therefrom.

5. A method for producing a high-strength metallurgical formed coke in a slight mutual agglomeration, which comprises:

forming green briquettes serving as an inner core material, said green briquettes comprising blended raw material coal fines having a maximum fluidity of up to 20 d.d.p.m.;

covering said green briquettes with an outer envelope material to a thickness of from 0.5 to 10 mm, said outer envelope material comprising a bituminous material having a C/H ratio of from 0.7 to 1.9; charging the resulting green composite briquettes into a horizontal coke oven battery; and carbonizing said green composite briquettes in said battery.

6. The method as claimed in claim 5, wherein said blended raw material coal fines serving as an inner core material have a particle size of up to 1.5 mm.

7. The method as claimed in claim 5, wherein said blended raw material coal fines serving as an inner core material have a particle size of up to 1.0 mm.

8. The method as claimed in claim 5, wherein the coke formed in said battery is discharged horizontally therefrom.

* * * * *